US005184638A

United States Patent [19]

Milocco et al.

[11] Patent Number: 5,184,638

[45] Date of Patent: Feb. 9, 1993

[54] DISHWASHER WITH REVERSIBLE MOTOR PUMPING SYSTEM

[75] Inventors: Claudio Milocco; Gianni Santarossa, both of Pordenone, Italy

[73] Assignee: Zanussi Elettrodomestici S.p.A., Pordenone, Italy

[21] Appl. No.: 792,596

[22] Filed: Nov. 15, 1991

[30] Foreign Application Priority Data

Nov. 15, 1990 [IT] Italy ..... 34085/90[U]

[51] Int. Cl.[5] ..... A47L 15/08

[52] U.S. Cl. ..... 134/186; 134/111; 134/179; 134/188; 415/169.1

[58] Field of Search ..... 134/111, 174, 176, 179, 134/186, 188; 415/116, 169.1, 169.2

[56] References Cited

U.S. PATENT DOCUMENTS 2,019,143 10/1935 La Bour ..... 415/169.1 X 3,612,714 10/1971 Ruspino ..... 134/186 X

*Primary Examiner*—Philip R. Coe

*Attorney, Agent, or Firm*—Wenderoth, Lind & Ponack

[57] ABSTRACT

In a reversible motor pumping system of a dishwasher, the reversible electrical motor has a drag shaft on which are mounted the impellers of a circulation pump and a discharge pump. The discharge pump is provided in a hydraulic discharge circuit so as to force fluid from the dishwasher after having washed the objects in the dishwasher. The discharge pump includes a lateral wall defining a chamber of a substantially circular section in which the impeller of the discharge pump is housed. An aspiration inlet is open to the chamber and communicates with the interior of the dishwasher while a delivery outlet is open to the chamber at a location spaced from the aspiration inlet such that a portion of the lateral wall defining the chamber extends between the aspiration inlet and the discharge outlet. This portion of the lateral wall constitutes a tooth of the discharge pump having a reduced inner diameter. At least one air intake is open to the chamber at the tooth of the discharge pump. Thus, the reduced pressure at the tooth of the discharge pump inhibits water being forced through the discharge circuit from flowing back through the air intake and into the bottom of the dishwasher. Therefore, problems which would otherwise occur in such a case are alleviated.

1 Claim, 2 Drawing Sheets

DISHWASHER WITH REVERSIBLE MOTOR PUMPING SYSTEM

BACKGROUND OF THE INVENTION

This invention relates to an automatic dishwasher equipped with a pumping system having a single reversible drag motor.

Dishwashers equipped with a pumping system are known. For example, EP-A-O 268 835 discloses a single reversible electrical motor having a drag shaft on which are fitted the impellers of a circulation pump and a discharge pump. The two pumps are activated alternately, according to the direction of rotation of the motor shaft.

The circulation pump is preferably of a centrifugal type, while the discharge pump is of the peripheral downflow type. In particular, the impeller of the discharge pump is set in a pumping chamber of substantially circular section defined by a lateral surface having an aspiration inlet and a delivery outlet. The aspiration inlet and the delivery outlet, respectively connected to the washing basin of the machine and to an external discharge conduit, are substantially adjacent but are separated over an angular extent by a portion of the lateral surface of the chamber which has a reduced inside diameter and is normally designated as the "tooth" of the pump.

As is known, when the delivery outlet of the discharge pump has a watertight connection with the hydraulic discharge conduit, the pump is generally provided with an air intake suitable for placing the delivery outlet in communication with the atmosphere through the washing basin, for example. This air intake has the function of preventing the discharge pump, when it is activated in the reverse rotation direction, from aspirating water from the external hydraulic system through the delivery outlet itself.

Also, during a discharge phase of the dishwasher, when the peripheral downflow type of discharge pump is activated in the forward direction of rotation, part of the water flowing out through the delivery outlet is expelled through the air intake. This amount of water collects on the bottom of the washing basin and returns to the aspiration inlet of the discharge pump with a certain delay, thus constituting an undesirable residue which limits the operations of that pump.

Also, when the discharge pump is activated in the forward direction of rotation, the air intake may easily be choked by the dirty water under pressure.

SUMMARY OF THE INVENTION

An object of this invention is to provide a dishwasher with a reversible motor pump system in which the discharge pump has an optimal function, substantially exempt from the problems noted above.

More particularly, it is the main object of the present invention to provide a dishwasher with a simple reversible motor pump system in which the discharge pump does not substantially aspirate water from the external hydraulic system and does not allow a residue of the water to accumulate during the discharge phases.

BRIEF DESCRIPTION OF THE DRAWINGS

Further characteristics and advantages of the invention will be made clear by the following description of a non-limiting example of the preferred embodiment thereof made with reference to the accompanying drawings, in which.

DETAILED DESCRIPTION OF THE PREFERRED EMBODIMENTS

Figure 1:
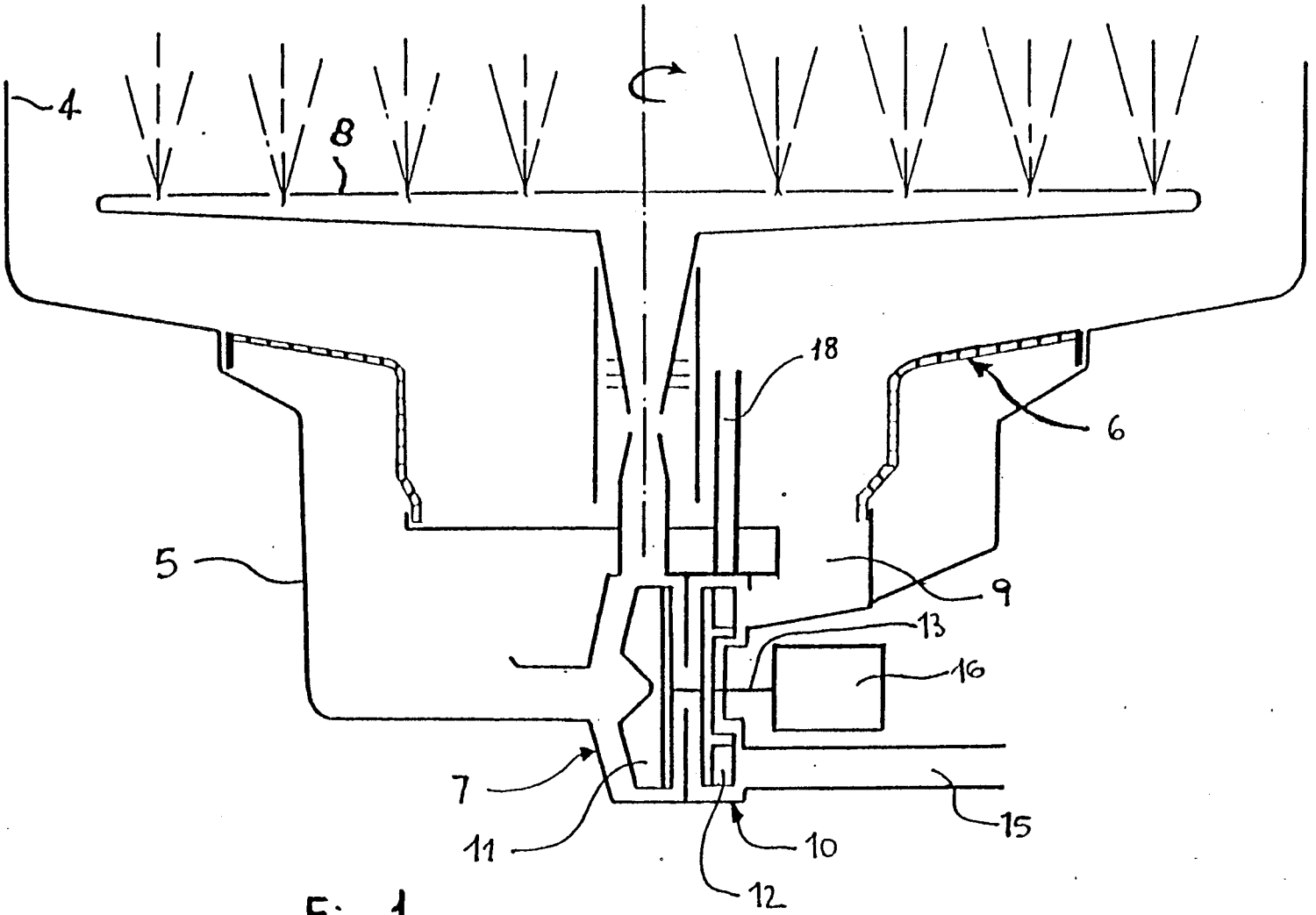
FIG. 1 is a schematic diagram of the principal components of the dishwasher according to the invention.

With reference to FIG. 1, the dishwasher principally includes a washing basin 4 (shown only partially) provided at the bottom thereof with a filtering device, generically indicated by reference numeral 6, and with a reservoir 5 for recovery of the washing water. The aspiration section of a circulation pump 7, preferably of a centrifugal type, communicates with the bottom of the reservoir 5. The pump 7 supplies at least one rotating reel 8 with water to spray the utensils to be washed in a known fashion.

Also, in a per se known way, the bottom of the washing basin 4 communicates with the aspiration section 9 of a discharge pump 10, the delivery outlet 15 of which is connected to a hydraulic discharge conduit (not shown).

The respective impellers 11 and 12 of the pumps 7 and 10 are, for example, fitted on a common drag shaft 13 of a reversible electric motor 16 as described in EP-A-O 268 835. The impellers 11 and 12 alternately pump the water from the respective zones of aspiration of the pumps 7 and 10.

In particular, the circulation pump 7 and the discharge pump 10 are operational during a washing phase and a discharge phase, respectively, when the drag shaft 13 is activated in first and second directions of rotation, respectively.

Figure 2:
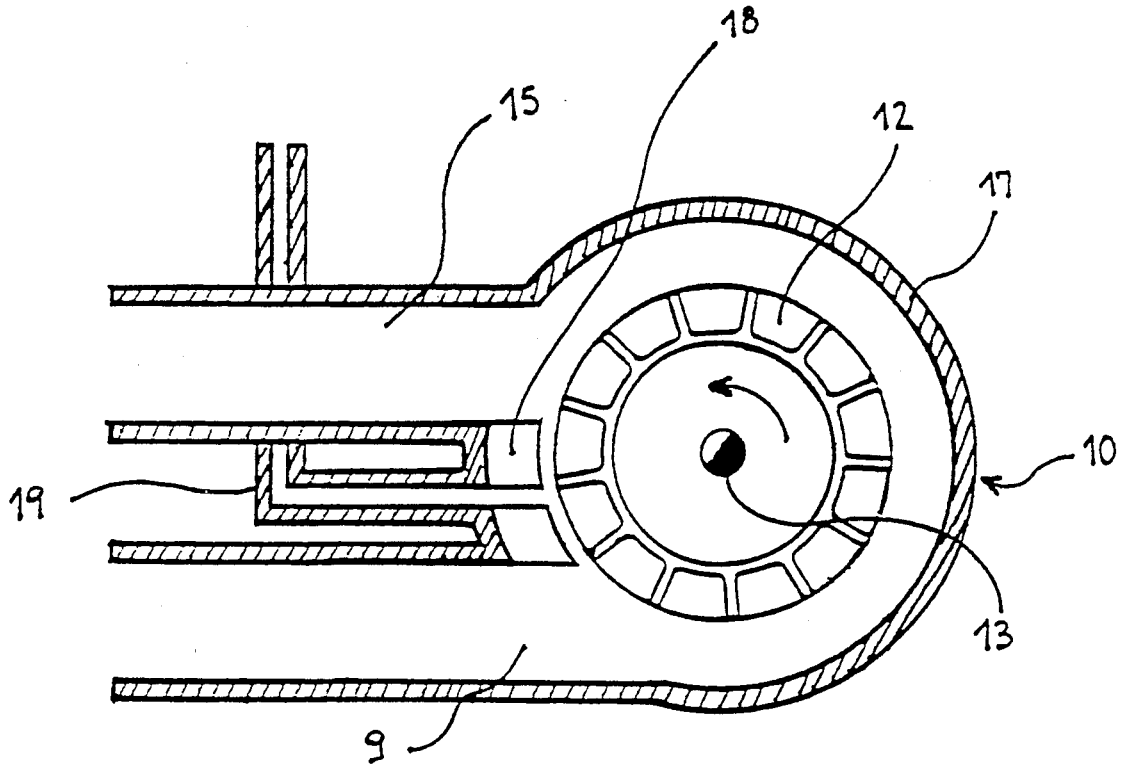
FIG. 2 is a cross-sectional view on an enlarged scale of a component of the dishwasher in FIG. 1.

With reference also to FIG. 2, the impeller 12 of the discharge pump 10 is of the peripheral downflow type and is set in a pump chamber 17 of substantially circular section. The aspiration inlet 9 and the delivery outlet 15 branch tangentially from the lateral surface of the chamber 17. In particular, the aspiration inlet 9 and the delivery outlet 15 are adjacent to each other and delimit an angular portion of the pumping chamber 17 (the so-called "tooth" of the pump) having a reduced internal diameter, hardly greater than that of the impeller 12. In a manner already known, the discharge pump 10 is also provided with at least one air intake 19 of a calibrated section capable, at least indirectly, of placing the inside of the chamber 17 in communication with the outside. For this purpose, as shown in FIG. 1, the effective length of the air intake 19 is made greater by a pipe extending upward, for example inside of the washing basin 5 (which is ventilated to the outside in a manner already known), to a suitable level dependent on the general dimensions of the hydraulic circuit of the dishwasher.

According to one aspect of the invention, the air intake 19 is drawn out of the pump 12 from its "tooth" 18, preferably from a substantially intermediate zone thereof, that is, from a zone of the pump where, as is known, a substantially reduced hydraulic pressure is present when the pump itself is activated by the forward rotation of the drag shaft 13 of the motor 16 (indicated by the arrow in FIG. 2).

Advantageously, therefore, during the discharge phase, the reduced pressure at the air intake 19 does not substantially cause any outflow of water through that same air intake, thereby minimizing the drawback of undesired water residue from accumulating in the discharge circuit of dishwasher. Also, the air intake 19 is only affected by a negligible amount of dirt in suspension in the discharge water and therefore is substantially exempt from problems of choking. As has also been proven experimentally, in fact, it would be difficult for the particles of dirt inside the chamber 17 of the pump to reach the air intake 19 because of the reduced dimensions of the cavity delimited by the impeller 12 and the tooth 18.

Also, when the discharge pump is activated in the reverse direction of rotation during the washing phases, in correspondence to the air intake 19 there is a slight depression inside the chamber 17 which allows the aspiration of surrounding air through the same air intake and avoids the eddying of water from the external discharge conduit through the delivery 15 of the pump 10; advantageously, therefore, the discharge pump is unprimed.

From the above description it appears evident that the objects of the invention are achieved in a particularly simple way.

Obviously the dishwasher described can be subjected to numerous modifications coming within the scope of the invention as defined by the appended claim.

I claim:

1. In a dishwasher having a hydraulic washing circuit through which fluid is forced to wash objects in the dishwasher and a hydraulic discharge circuit through which the fluid is discharged from the dishwasher after having washed objects in the dishwasher, a pump system comprising: a reversible motor having a drag shaft rotatable in opposite first and second directions of rotation; a circulation pump provided in the hydraulic washing circuit so as to force fluid through the washing circuit, said circulation pump including an impeller fixed to the drag shaft of said motor so as to force fluid through the hydraulic washing circuit when said motor is rotating in the first direction of rotation; and a peripheral downflow type of discharge pump provided in the hydraulic discharge circuit so as to force fluid from the dishwasher through the discharge circuit, said discharge pump including an impeller fixed to the drag shaft of said motor so as to force fluid through the hydraulic discharge circuit when said motor is rotating in the second direction of rotation, a lateral wall defining a chamber of a substantially circular section in which the impeller of the discharge pump is housed, an aspiration inlet open to said chamber and communicating with the interior of the dishwasher, a delivery outlet open to said chamber at a location spaced from said aspiration inlet along said lateral wall such that a portion of said lateral wall extends between said aspiration inlet and said discharge outlet, said portion of the lateral wall constituting a tooth of the discharge pump having a smaller inner diameter than the remaining portion of the discharge pump, and at least one air intake open to said chamber at said tooth of the discharge pump and extending upwardly in the dishwasher therefrom, said air intake being in communication with the outside atmosphere.

* * * * *